United States Patent [19]

Fleischer et al.

[11] 4,257,912

[45] Mar. 24, 1981

[54] CONCRETE ENCAPSULATION FOR SPENT NUCLEAR FUEL STORAGE

[75] Inventors: Leonard R. Fleischer, Mt. Lebanon, Pa.; Muthian Gunasekaran, Woodland Hills, Calif.

[73] Assignee: Westinghouse Electric Corp., Pittsburgh, Pa.

[21] Appl. No.: 914,828

[22] Filed: Jun. 12, 1978

[51] Int. Cl.[2] ..... G21F 9/36; G21F 5/00

[52] U.S. Cl. ..... 252/301.1 W; 106/99; 206/524.2; 206/524.3; 206/524.9; 250/506; 250/507; 250/517

[58] Field of Search ..... 252/301.1 W, 478; 106/99; 250/506, 507, 517; 206/524.2, 524.3, 524.9; 428/35

[56] References Cited

U.S. PATENT DOCUMENTS

| | | | |
|---|---|---|---|
| 1,113,555 | 10/1914 | Haldeman | 106/97 |
| 1,348,099 | 7/1920 | Ellis et al. | 106/97 |
| 2,716,705 | 8/1955 | Zinn | 250/518 |
| 2,726,339 | 12/1955 | Borst | 250/518 |
| 2,987,406 | 6/1961 | Minnick | 106/97 |
| 2,992,175 | 7/1961 | Borst | 252/478 |
| 3,122,513 | 2/1964 | Dempsey | 252/478 |
| 3,166,518 | 1/1965 | Barnard | 252/503 |
| 3,173,884 | 3/1965 | Jackson | 252/478 |
| 3,434,978 | 3/1969 | Vogel | 252/478 |
| 3,716,386 | 2/1973 | Kempster | 106/90 |
| 3,753,849 | 8/1973 | Duff | 428/414 |
| 3,779,938 | 12/1973 | Weakley | 252/301.1 W |
| 3,834,916 | 9/1974 | Kesler | 106/99 |
| 3,865,779 | 2/1975 | Oya et al. | 106/99 |
| 3,884,839 | 5/1975 | Bon et al. | 252/478 |

FOREIGN PATENT DOCUMENTS

| | | | |
|---|---|---|---|
| 1265290 | 3/1972 | United Kingdom | 250/506 |

OTHER PUBLICATIONS

Boase, D. G. et al., "The Canadian Spent Fuel Storage Canister: Some Materials Aspects", *Nuclear Technology*, vol. 32 (Jan. 1977), pp. 60–71.

Jaeger, R. G. et al., Eds, *Engineering Compendium on Radiation Shielding*, vol. 2, Springer-Verlag, N.Y. 1975, pp. 75–78.

Cook, D. J. et al., *Cement and Concrete Research*, vol. 4, Pergammon Press, Inc. 1974, pp. 497–509.

Colombo, P. et al., "Some Techniques for the Solidification of Radioactive Wastes in Concrete", *Nuclear Technology*, vol. 32 (Jan. 1977) pp. 30–38.

*Primary Examiner*—Benjamin R. Padgett
*Assistant Examiner*—Deborah L. Kyle
*Attorney, Agent, or Firm*—Edward L. Levine; Z. L. Dermer

[57] ABSTRACT

Concrete systems, mixtures and methods for encapsulating and storing spent nuclear fuel. Fuel discharged from nuclear reactors in the form of rods or multi-rod assemblies is completely and contiguously enclosed in concrete having incorporated therein metallic fibers to increase thermal conductivity and polymers to decrease fluid permeability. The metallic fibers and the polymers can be distributed in a single concrete layer, or separate contiguous layers can be utilized for the conductivity and impermeability characteristics.

8 Claims, 5 Drawing Figures

CONCRETE ENCAPSULATION FOR SPENT NUCLEAR FUEL STORAGE

BACKGROUND OF THE INVENTION

1. Field of the Invention

This invention relates to the storage of spent nuclear fuel, and more particularly to the use of concrete for such storage.

2. Description of the Prior Art

Many nuclear reactors utilize fuel in the form of pellets encased in metallic cladding. These rods may be bundled in a duct-type structure, or integrated through a skeletal structure which includes grids spaced along the assembly length. Upon discharge of such assemblies from a nuclear reactor, the fuel rods contain not only fission products in the form of solids and gases, but also fissionable isotopes which are useful as fuel in reactors subsequent to reprocessing.

Typically fuel assemblies are discharged from the reactor and placed within a water filled spent fuel storage pool which serves as a source of thermal cooling and also radiation shielding. These pools, however, are in relatively short supply and, because of the lack of sufficient reprocessing facilities, such pools cannot provide the long-term storage presently needed. Further, underwater storage may not provide acceptably long-term stability for storage, and long-term storage facilities either above ground or in geologically stable underground structures are presently being considered. The proposed solutions, however, have not been publically accepted to date.

Accordingly, it is desirable to provide alternative systems for intact storage of spent nuclear fuel. A preferable system for storage will meet the following requirements. The radioactive materials in the spent fuel must be contained, and leaching of the encapsulated fuel and breaching of the encapsulation must not occur over an extended period of storage time. The encapsulation must permit adequate removal of the heat of radioactive decay so as not to allow the fuel to reach temperature levels that would endanger the integrity of its containment. It is further advantageous to have the encapsulation system providing sufficient shielding for the protection of associated structures and personnel against gamma and neutron radiation emitted from spent fuel rods. It may prove to be additionally advantageous to have such systems provide the ability for relatively easy removal of the spent fuel from its containing structure subsequent to a predetermined amount of radioactive decay and at a time when the spent fuel is desired for reprocessing and retrieval of desired isotopic species. Alternatively it may be desirable to provide storage systems which provide a substantial degree of difficulty regarding retrieval of or accessibility to the fuel so as to alleviate the potential for terrorist and diversion activities. And, because of the substantial need for such storage systems on a short-term time period, it is desirable to utilize near state-of-the art technology to provide reliable encapsulation systems available within a short period of time.

SUMMARY OF THE INVENTION

While concrete structures have been utilized in the nuclear industry as a shielding spaced from reactor structures, concrete has never been considered as a mixture useful in long-term storage of spent fuel while in contiguous contact with the stored fuel rod or assembly. This invention teaches the utilization of concrete mixtures completely and contiguously encapsulating the spent fuel such that the radioactive materials are contained, decay heat is removed, shielding against gamma and neutron radiation is provided, and near state-of-the art technology is utilized. The spent fuel, accordingly, is completely encased in concrete having mixed therein metallic fibers to enhance thermal conductivity for distribution and removal of the radioactive decay heat, and polymers mixed within the concrete to provide a substantially impermeable structure which alleviates leaching. The metallic fibers and polymers can be uniformly distributed throughout the concrete. Alternatively, an inner layer of concrete having metallic fibers can completely surround the spent fuel, and an outer layer of concrete having polymers can completely surround the inner concrete layer. Additional means for removal of the decay heat can be provided such as the utilization of fans or other structures to enhance convection from the concrete outer surface.

Additionally, polymers can be impregnated into the capillaries of the concrete structure by the addition of monomers and a catalyst suitable to convert the monomer to a polymer within the concrete capillaries. In addition to a chemical catalyst, the monomer to polymer conversion can be achieved by other actions such as the addition of heat or radiation. Further, organic additives can be utilized as part of the bonding agents for the concrete which, when subjected to a predetermined temperature, decompose so as to allow removal of the spent fuel by destroying the concrete. Specific neutron absorbers can also be added to the concrete mixtures to provide additional shielding and, the free moisture content of the concrete is preferably adjusted compatible with the requirements of high thermal conductivity and low permeability, particularly where an inner layer of high conductivity concrete and an outer layer of low permeability concrete is utilized.

BRIEF DESCRIPTION OF THE DRAWINGS

The advantages, nature, and additional features of the invention will become more apparent from the following description, taken in connection with the accompanying drawings, in which.

DESCRIPTION OF THE PREFERRED EMBODIMENTS

Figure 1:
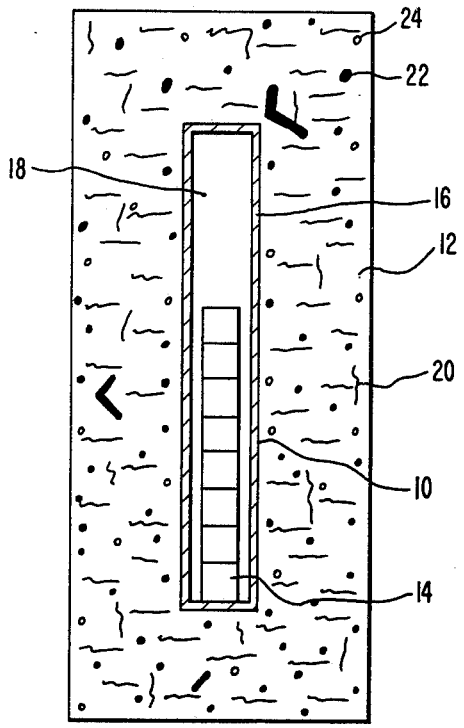
FIG. 1 is an elevation view, in section, of one embodiment of the invention.

Referring now to FIG. 1, there is shown a nuclear fuel rod 10 completely and contiguously enclosed within a concrete matrix 12 as discussed hereinafter. The fuel rod 10 includes a plurality of nuclear fuel pellets 14 hermetically sealed within a metallic cladding 16 such as stainless steel or zirconium alloys. During reactor operation the initial fuel, such as a ceramic form of uranium dioxide ($UO_2$), is "burned" such that upon discharge from the reactor the fuel rod contains radioactive species including solid and gaseous fission products in a highly radioactive state. Also contained are fissionable isotopes of substantial value when reprocessed and placed within a reactor core. The fission product gases typically reside in a plenum 18 in the upper portion of the fuel rod 10, and are in fluid communication with the entire interior of the fuel rod. Although hermetically sealed, any spent fuel storage system should take into account the assumption of failure of the fuel rod cladding and release of the fission products to the containing structure such as the concrete matrix 12, as well as the potential for leaching. Further, the radioactive fission products discharge a substantial amount of decay heat which must also be removed by the containing structure so as not to allow overheating and overstressing of the fuel rod which could lead to rod failure. This is provided in the concrete mixture 12 shown in FIG. 1 by incorporating therein means for enhancing the thermal conductivity of the concrete such as the metallic fibers 20 and means for enhancing impermeability such as the polymers 22 which fill the capillaries 24 within the concrete matrix 12.

Figure 2:
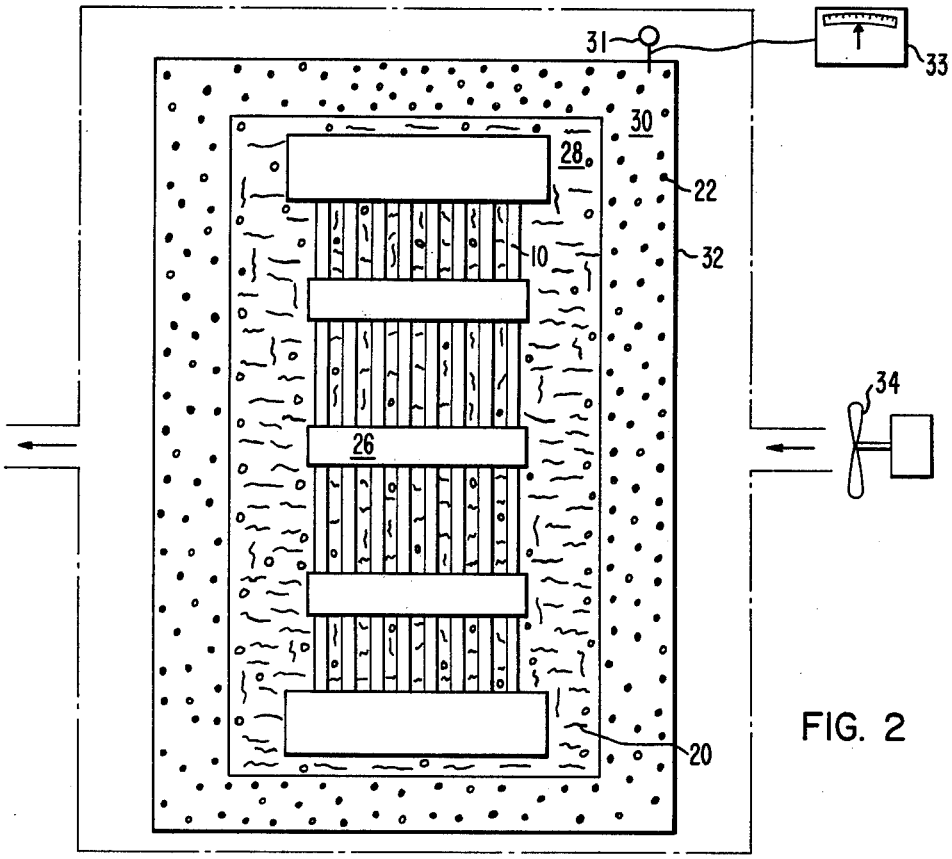
FIG. 2 is an elevation view, in section, of another embodiment of the invention.

FIG. 2 shows another embodiment wherein a fuel assembly 26, comprised of a plurality of fuel rods 10 and support structure which may or may not be removed from the rods prior to encapsulation, is enclosed within an inner 28 and outer 30 layer of concrete. The inner layer 28 includes metallic fibers 20 uniformly dispersed throughout the layer 28 which completely encases and contacts the fuel assembly 26. The outer layer 30 is comprised of concrete having impregnated therein polymers 22 so as to increase the impermeability of the outer layer 30. Also shown in FIG. 2 is a means for enhancing convective cooling of the outer surface 32 of the outer layer 30 such as the fan or blower 34. Natural convective cooling can also be utilized. It will be evident to those skilled in the art that other means of cooling such as conduction can be utilized by passing sufficient cooling conduits through the concrete matrix and flowing a desired cooling agent therethrough. Such cooling, however, is more active and would require substantial maintenance and monitoring as compared to reliance upon the preferred natural or forced convective cooling means. Conduction to ground can also be advantageously utilized. Temperature and other monitors 31 adjacent or within the concrete, can be utilized to indicate thermal or other conditions at a remote-device 33. It will be noted that with these encapsulation configurations the fuel rods or assemblies act as reinforcing bars, giving the complete encapsulation system more strength than a mere concrete block.

As will be evident to those skilled in the art, the thickness, density, thermal conductivity, moisture content, and other characteristics of the concrete layer or layers can be varied in accordance with the specific requirements of the spent fuel placed within the concrete encapsulation. For example, the decay heat and activity within a spent fuel rod is substantially a decreasing function of the amount of time which has passed since discharge of the rod from a nuclear reactor core. Accordingly, the disclosed invention is visualized as being used in conjunction with short-term storage means such as water cooling for a period of up to approximately five years prior to encapsulation in a concrete matrix. The matrix characteristics should be adjusted, however, so that a fuel rod 10 or fuel assembly 26 at the center of a concrete capsule, that area most insulated from the exterior convective cooling, is not insulated to an untenable extent. Accordingly, the decay heat of the spent fuel must be conducted outward through the matrix and the metallic fibers at a high enough rate so that the temperature at the cladding-concrete interface does not become excessive. In this context, upper interface temperature limits can be defined progressively, for example, (a) the cladding melting temperature must not be exceeded, (b) temperatures must be below those at which the cladding could deform under internal fission gas pressure, (c) temperatures must be below those at which progressive oxidation of the cladding occurs, (d) temperatures must be below those at which the cladding undesirably reacts with components of the concrete, and (e) temperatures must be below those at which the properties of the concrete are undesirably degraded. A preferred upper temperature limit which is compatible with these criteria is approximately 200° C.

For example, an average fuel assembly 26 discharged from a pressurized water reactor (PWR) after five years of post-irradiation cooling in a liquid storage pool has a decay power density in each fuel rod 10 of approximately $4\times10^{-4}$ of the steady state fission power density of the rod while in the reactor. For a typical PWR fuel rod which operates at approximately 10 killowatts per foot (kw/ft) in a reactor, the decay power density five years after removal of the rod would be about $4\times10^{-3}$ kw/ft per rod or approximately 1 kilowatt/ft for an assembly having 250 rods. The rods in a typical assembly are approximately twelve feet in length. For ordinary concrete which has a thermal conductivity of approximately 1 BTU-ft/hr-ft$^2$-°F. which is twelve inches thick, a steady energy output at one kilowatt per foot would give an approximate temperature rise from the outer surface of the concrete to the assembly center line of approximately 430° C. However, increasing the thermal conductivity of the concrete by a factor of ten would decrease the temperature rise to approximately 43° C. and, with reasonable surface cooling of the concrete, which can be provided merely by convective means, the center line temperature will be well within the maximum temperature criteria. Further, doubling the thickness of the concrete beyond the assembly for other reasons to, for example, twenty-four inches, would result in a thermal differential of approximately 59° C. with fiber reinforced concrete.

Figure 3:
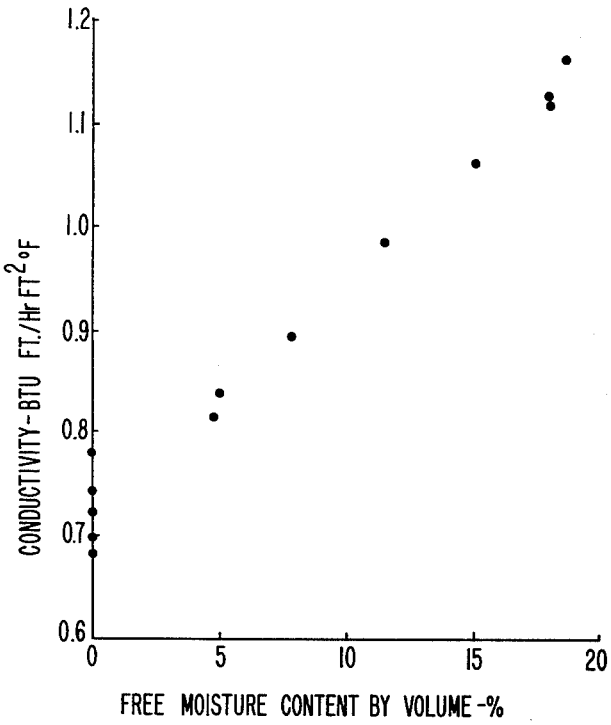
FIG. 3 is a graph plotting concrete free moisture content (percent, X axis) versus conductivity (BTU ft/hr ft$^2$ °F., Y axis)

Thermal conductivity of concrete is a complex function of the density of the concrete, the types of aggregates and cements used, and the free moisture content. In most concretes, these parameters control a variability in conductivity over a factor of about two. This is illustrated in Table 1 which shows the variation of thermal conductivity with aggregate type and in FIG. 3 which shows the variation of thermal conductivity as the function of free moisture content for a concrete made with dolerite aggregate.

TABLE 1

VARIATION IN CONCRETE THERMAL CONDUCTIVITY

| Type of Aggregate | Unit Weight of Concrete lb per cu ft (kg/m$^3$) | Conductivity BTU ft per hr sq ft °F. (g cal m/hr m$^2$ °C.) |
|---|---|---|
| Barytes | 227 (3640) | 0.8 (1.18) |
| Igneous | 159 (2550) | 0.83 (1.19) |
| Dolomite | 160 (2560) | 2.13 (3.15) |
| Lightweight Concrete | 30–110 (180–1760) | 0.08–0.35 (0.11–0.52) |

TABLE 1-continued

VARIATION IN CONCRETE THERMAL CONDUCTIVITY

| Type of Aggregate | Unit Weight of Concrete lb per cu ft (kg/m$^3$) | Conductivity BTU ft per hr sq ft °F. (g cal m/hr m$^2$ °C.) |
|---|---|---|
| (oven-dried) | | |

Figure 4:
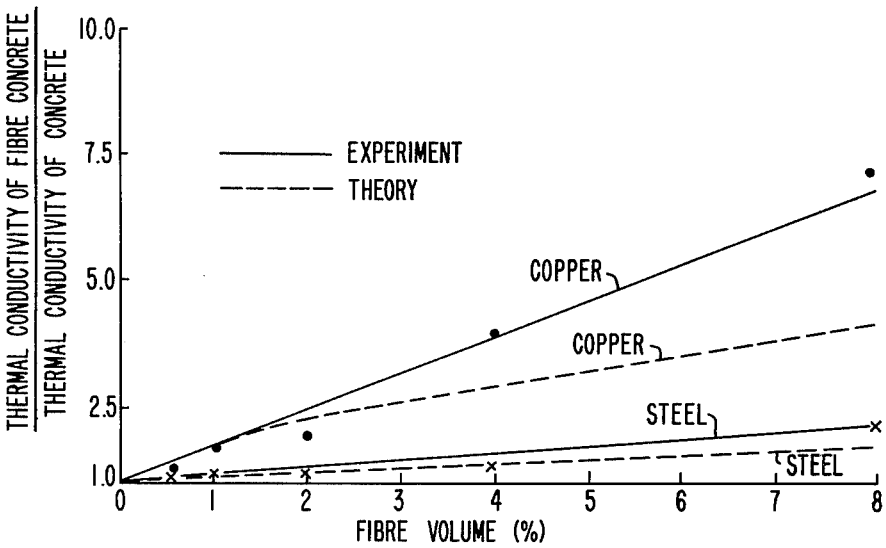
FIG. 4 is a graph plotting volume percent of metallic fiber (X axis) versus a ratio representative of concrete thermal conductivity (Y axis)

It will be apparent that the desired exemplary conductivity of 10 BTU-ft/hr sq ft °F. cannot be achieved by modification of the aggregate type and free moisture content alone. However, major conductivity increases can be achieved by dispersing metallic fibers throughout the concrete. Further, the methods for achieving metallic dispersement presently exist in fiber reinforcement technology and, improvements in properties useful for spent fuel storage in addition to conductivity are also achieved. Metallic fibers such as copper, aluminum or steel are preferred, and other fibers evidencing good thermal conductivity can also be utilized. Fiber reinforcement of concrete using randomly dispersed fibers having aspect ratios (length to diameter) of between 60 and 100 are well known as a means for producing concrete with good flexural and fracture toughness properties. Additionally, compressive, sheer, fatigue, impact and freeze-thaw durability properties are also increased. It has been demonstrated by Cook et al, Cement and Concrete Research, Volume 4, pages 497–509 (1974) that the addition of copper fibers in small volumetric concentrations can increase the thermal conductivity of fiber reinforced concrete by approximately a factor of between 7 and 10 (FIG. 4). It has also been shown that compaction by vibration produces some fiber alignment which can be oriented in the direction of heat flow, which explains the difference between the experimental and theoretical values in FIG. 4. It is accordingly expected that with the use of efficient mixers, such as the Omni-Mixer and the addition of suitable surfactants to the concrete, tailored values of thermal conductivity for specific spent fuel storage application can be obtained by increased metallic fiber content.

In addition to enhanced conductivity, gamma ray absorption by the concrete is also enhanced by an increased density achieved through the use of natural heavy aggregates or artificial aggregates such as copper and other metal fibers. The aggregates, however, should be well graded so as to avoid segregation in the setting process. Table 2 presents exemplary fine aggregate grading for concretes, shown as a function of sieve analysis. It has been found that through the use of Type I Portland cement with pozzolana and iron shot, a concrete having a density of over 300 pounds per cubic foot can be obtained. Accordingly, it is envisaged that the use of quick setting cements such as Regulated Set Cement, a modified Portland cement incorporating fast set and strength gain, available from the Huron Cement Division of National Gypsum Co., in combination with Type I Portland cement and metallic aggregates, such as metal fibers and/or metal shot, a concrete having a density of between 300 and 600 pounds per cubic foot can be conveniently produced without concern for segregation. Such high density concrete not only increases the thermal conductivity, but also decreases the thickness of the encapsulating concrete required to achieve a predetermined shielding criteria. For a given conductivity, a reduced concrete thickness also results in a lower temperature rise across the concrete encapsulation thickness.

TABLE 2

Sieve Analysis of Fine Aggregates

| Sieve No.* 26 | 2Q ROK % by wt. | #1 DRY % by wt. |
|---|---|---|
| +20 | 1.22 | 0.030 |
| −20 + 40 | 90.14 | 25.06 |
| −40 + 60 | 8.49 | 47.16 |
| −60 + 80 | 0.12 | 17.19 |
| −80 + 100 | 0.005 | 4.06 |
| −100 + 120 | 0.006 | 3.03 |
| −120 | 0.007 | 2.55 |
| −140 | — | 0.93 |

| | Berkeley Fines % by wt. | EFJ SAND % by wt. |
|---|---|---|
| +60 | 5.50 | — |
| −60 + 80 | 9.30 | — |
| −80 + 100 | 6.02 | — |
| −100 + 120 | 9.89 | — |
| −120 + 140 | 7.85 | — |
| −140 + 170 | 12.39 | — |
| −170 + 200 | 10.95 | 0.11 |
| −200 + 230 | 5.95 | 0.33 |
| −230 + 270 | 7.97 | 0.90 |
| −270 + 325 | 9.95 | 3.05 |
| −325 + 400 | 5.06 | 8.27 |
| −400 | 9.07 | 87.27 |

*-denotes "passing through";
+ denotes "retained on"

Since any encapsulation system for spent nuclear fuel must account for the possibility of release of fission products and concern for leaching, the permeability of the encapsulating concrete must be decreased. While thermal conductivity through concrete is increased by a higher free moisture content, permeability is also increased. Since the desired end result is increased conductivity and decreased permeability, a trade-off must be established between these properties regarding the free moisture content of the concrete. Impermeability can also be enhanced by the addition of polymers to the concrete capillary structure and, where different degrees of free moisture content are desired, a spent fuel storage configuration such as shown in FIG. 2 can advantageously be applied, the inner layer 28 having a higher free moisture content and the outer layer 30 having a lower free moisture content. Cement pastes having a low water-to-cement ratio are known to possess very low permeability. For example, a well cured hydraulic cement paste made with a water-to-cement ratio of about 0.4 has a permeability approximately equal to that of dense trap rock, approximately $2.5\times10^{-12}$ centimeters per second. Comparisons of the permeabilities of natural minerals to cement pastes of varying water-to-cement ratios are shown in Table 3.

TABLE 3

Permeabilities of Rocks and Cement Pastes

| Type Of Rock | Permeability cm/sec | Water-Cement Ratio Of Mature Paste Of The Same Permeability |
|---|---|---|
| Dense trap | $2.47\times10^{-12}$ | 0.38 |
| Quartz diorite | $8.21\times10^{-12}$ | 0.42 |
| Marble | $2.39\times10^{-11}$ | 0.48 |
| Marble | $5.77\times10^{-10}$ | 0.66 |
| Granite | $5.35\times10^{-9}$ | 0.70 |
| Sandstone | $1.23\times10^{-8}$ | 0.71 |
| Granite | $1.56\times10^{-8}$ | 0.71 |

The permeability of a cement paste as a function of the state of hydration due to curing is shown in Table 4 for a water-to-cement ratio of 0.7.

TABLE 4

| Reduction In Permeability Of Cement paste | |
|---|---|
| Age, Days | Permeability cm/sec |
| Fresh | $2 \times 10^{-4}$ |
| 5 | $4 \times 10^{-8}$ |
| 6 | $1 \times 10^{-8}$ |
| 8 | $4 \times 10^{-9}$ |
| 13 | $5 \times 10^{-10}$ |
| 24 | $1 \times 10^{-10}$ |
| Ultimate | $6 \times 10^{-11}$ |

In addition to the water-to-cement ratio, the overall cement content in a concrete additionally affects permeability as shown in Table 5 which is based upon concretes typically utilized in dams.

TABLE 5

| Permeability Of Concrete | | |
|---|---|---|
| Cement Content lb/cu yd (kg/m$^3$) | Water-Cement Ratio | Permeability $10^{-10}$ cm/sec |
| 251 (151) | 0.74 | 2.44 |
| 263 (155) | 0.69 | 8.23 |
| 282 (167) | 0.54 | 4.24 |
| 376 (223) | 0.46 | 2.77 |

Figure 5:
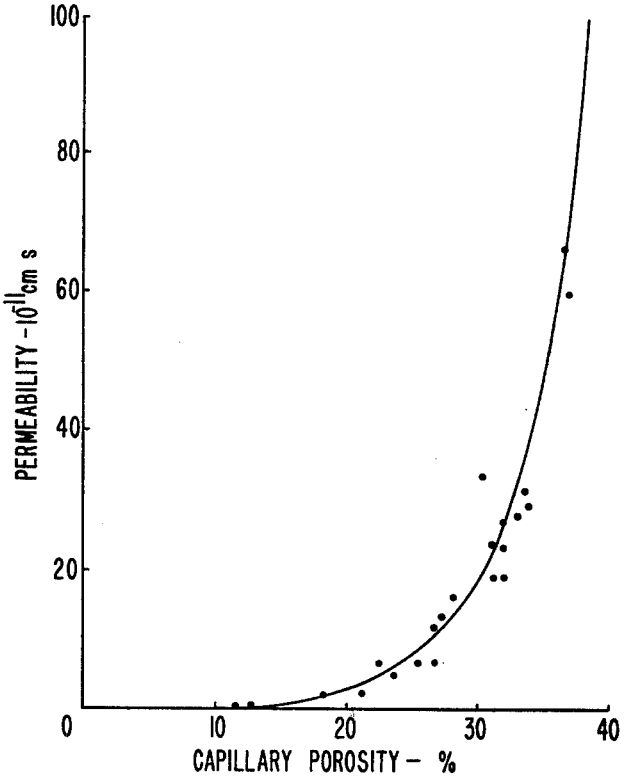
FIG. 5 is a graph plotting cement paste capillary porosity (percent, X axis) versus permeability ($10^{-11}$ cm sec, Y axis).

By appropriately selecting the cement content of a mix and the addition of pozzolanic material such as fly ash in conjunction with suitable curing procedures, very low permeability concrete can be produced. Physically, the permeability of cement paste is controlled primarily by the capillary pores as shown in FIG. 5 since the gel pores are small, on the order of between 10 to 15 Å. In addition to the direct impregnation of organic resins or polymers to fill the concrete capillary network, a very low permeability concrete can be obtained by incorporating within the concrete mixture suitable monomers and a catalyst such that the organic liquid system can be converted to a polymeric system within the microstructure of the concrete under the influence of a driving factor such as heat or radiation. In addition to use of the monomer to polymer conversion initiated during the mixing stage, monomers can be injected, for example subsequent to evacuation, into the microstructure of concrete and, in conjunction with a suitable catalyst and activating means, be converted to polymers which fill the concrete capillary microstructure.

The folllowing exemplary compositions and procedures are appropriate to the embedding and encapsulation of spent nuclear fuel rods and/or assemblies in concretes to give the desired characteristics of relatively high thermal conductivities and low permeabilities. Other examples will occur to those skilled in the art as will substitutes for the individual ingredients or parameters used.

The examples each include mixing of the ingredients in a high efficiency mixer, such as the Omni-Mixer, casting of the concrete mix in a mold to embed and encapsulate the spent fuel rods or assemblies and aiding the set-up of the concrete by vibrating the mold, which tends to align the metal fibers and to eliminate voids. For the polymer concrete examples, either as the entire encapsulation or as a low permeability layer external to an embedment in a hydraulic cement bonded concrete, a vacuum, on the order of 30 mm Hg, is utilized during the molding process.

EXAMPLE, POLYMER CONCRETE

Composition

| Material | Aggregate and Filler (wt. %) | Total (wt. %) |
|---|---|---|
| Metal Fibers (~10 vol. %) | | 31 |
| Copper fibers, 1.9 cm long × 0.045 cm diam | | |
| Coarse Aggregate | | 8 |
| Crushed dolomite rock | | |
| Fine Aggregate and Filler | | 46 |
| 2 Q ROK Sand | 50 | |
| #1 Dry Sand | 17 | |
| Berkely Sand Fines | 8 | |
| EFJ Sand | 12 | |
| c-331 Hydrated Alumina | 13 | |
| | 100 | |

| Organics Binder | Binder (wt. %) | Binder (vol. %) |
|---|---|---|
| Polyester resin | 74 | 72 |
| Styrene monomer | 21 | 20 |
| Surfactants | 4 | 7 |
| Catalyst (MEKP) | 1 | 1 |
| | 100 | 100 |

Curing

The mixture is molded on a vibrating table inside a vacuum tank. The tank is evacuated with the vibrator running and maintained at about 30 mm Hg vacuum. The mixture is then heated to approximately 60° to 70° C. The tank is then subjected to a pressure pulse and reevacuated at 10 minute intervals. Polymerization is well established in approximately 30 minutes and vacuum and pulsing are then discontinued. Polymerization is essentially complete in three hours and the concrete body can be removed from the mold.

Coating

The surface layer of the concrete body may be depleted in polymer by evaporation. Therefore, externally applied protective coatings can be advantageously utilized. Suitable coating materials such as a polyacrylic/paraffin seal coat developed at Brookhaven National Laboratory ("Concrete-Polymer Materials", Fifth Topical Report, BNL 50390, Dec. 1973) are available. Other proprietary formulations are available from commercial sources, such as HALAR ECTFE (Allied Chemical Corp.), SIERRACIN (Sierracin Corp.), and ENVIREZ (PPG Industries). Coatings may be painted, sprayed, or plasma sprayed onto the polymer concrete surface, and allowed to polymerize in place.

EXAMPLE, POLYMER IMPREGNATED CONCRETE

Composition

| Material | Fine Aggregate (wt. %) | Total (wt. %) |
|---|---|---|
| Metal Fibers (~10 vol. %) | | 51.2 |
| Copper fibers, 1.9 cm long × 0.045 cm diam | | |
| Coarse Aggregate | | 19.6 |

-continued

| | | |
|---|---|---|
| Crushed dolomite rock | | |
| Fine Aggregate | | 19.6 |
| 2 Q ROK Sand | 50 | |
| #1 Dry Sand | 17 | |
| Berkely Sand Fines | 8 | |
| EFJ Sand | 12 | |
| C-331 Hydrated Alumina | 13 | |
| | 100 | |

| Cement & Pozzolana (wt. %) | | |
|---|---|---|
| Cement and Pozzolana | | 6.8 |
| Type I Portland Cement | 29 | |
| Regulated Set Cement | 28 | |
| Fly Ash | 43 | |
| | 100 | |

| Water and Surfactant (wt. %) | | |
|---|---|---|
| Water and Surfactant | | 2.8 |
| Water | 98 | |
| Plastiment | 2 | |
| | 100 | 100 |

Curing

The mixture is molded on a vibrating table, with continued vibration during casting and subsequently for approximately one to two hours. The molds are stripped after a 24 hour set-up period. The molds are then cured in steam at approximately 150° C. for an additional 24 hours, and then maintained in air for a minimum of 24 hours prior to further processing; internal heating by decay heat and radiation heating continue the curing process.

Impregnation

The concrete surface is dried in a vacuum at a 150° C. surface temperature for four hours. It is cooled if external heating was applied. A resin mix is injected (for example, methyl methacrylate monomer (MMA), trimethylolpropane-trimethacrylate cross-linking agent (TMPTMA), and benzoyl peroxide (BPO) catalyst in proportions 90:10:1 by wt. ) into the vacuum chamber to immerse the concrete bodies. Approximately fifteen to thirty minutes is allowed for absorption, and the concrete body is then pressurized to approximately fifty psig to force liquid into the capillary pores. The pressurization is held for one to two hours. The pressure is then reduced and the excess resin mix is drained. Unused resin mix can be stored under refrigeration to retard polymerization until the next impregnation.

The concrete is then repressurized to twenty to twenty-five psig and heated, if necessary, to a surface temperature of 60°–70° C., which is maintained for one to two hours. The volatiles in the containing chamber are then removed, ambient air is admitted, and the encapsulated fuel is removed to a storage area.

The fine capillary pore network expected from the exemplary matrix should limit penetration of the impregnant to a layer adjacent the surface approximately one to six inches deep, which is an indication of the impermeability of the matrix. The impregnant polymer will seal the surface and further reduce the permeability of the body. Matrices with large capillary pore diameters will be penetrated by the resin mix to a greater depth and made less permeable by in situ polymerization. Radiation from the encapsulated fuel can be expected to promote polymerization and enhance cross-linking.

EXAMPLE, DUAL LAYER CONCRETE

A layered encapsulation arrangement combines a metal fiber enhanced, hydraulic cement bonded concrete as the primary encapsulation with a subsequently added surface layer of metal fiber enhanced polymer concrete. It comprises the concrete composition, molding, and curing processes of the above polymer impregnated example concrete for the inner layer. After drying, a polymer concrete of the composition described in the polymer concrete example is cast around the inner layer. Final curing as in the polymer concrete Example completes the process.

It will be evident that concretes formed in accordance with this disclosure having high thermal conductivity and low permeability will require mechanical procedures which destroy the concrete cell to remove the fuel rods or assemblies from the encapsulating concrete. Such procedures can include drilling and pneumatic hammering which would require remote handling. However, since the residual fissile fuel within the control rods is of substantial value, an easier method of spent fuel removal can be desirable. To this end, organic bonding within the concrete can be utilized which, when exposed to high temperatures such as those in range of 300° to 500° C. from an external heat source degrade and break down. Such an approach would preferably be utilized where other precautions are taken to decrease diversion activities.

If increased shielding is required beyond that achieved by the addition of the metallic fibers and the increased concrete density, specific materials having high thermal neutron absorption characteristics can be also impregnated within the concrete matrix. For example, boron salts can be dispersed throughout the concrete at the time of mixture, or incorporation of additional metallic fibers such as those of cadmium or other well-known neutron absorbers can increase the neutron absorptivity.

It will be apparent that a high conductivity-low permeability concrete in accordance with this invention can also be utilized for long term storage of radioactive nuclear wastes contained within sealed metallic drums or tanks.

Thus, this invention and modifications which do not depart from the scope thereof can be utilized for safe, long-term storage of spent nuclear reactor fuel and other metallic encased radioactive species by utilization of concretes having high thermal conductivity and low permeability as well as structural, shielding, and diversion limitation or retrieval advantages.

We claim:

1. A system for fixed storage of spent nuclear fuel having activated fission products contained within a metallic fuel rod housing, comprising: a uniform concrete contiguously and completely surrounding said housing having metallic fibers to enhance thermal conductivity and polymers to enhance impermeability and means for convectively cooling the exterior surface of said concrete.

2. A method of fixedly storing spent nuclear fuel having radioactive species contained within a metallic fuel rod housing comprising completely encapsulating said housing in a uniform concrete having metallic fibers and polymers, said mixture being in direct contact with said housing.

3. A method of fixedly storing spent nuclear fuel having radioactive species contained within a metallic fuel rod housing comprising:

(a) completely encapsulating said housing in a contiguous inner concrete layer having uniformly dispersed metallic fibers; and (b) completely encapsulating said inner layer in an outer concrete layer, contiguous with said inner layer, having polymers dispersed within capillaries of said outer concrete.

4. A system for fixed storage of spent nuclear fuel having radioactive species contained within a metallic fuel rod housing comprising:

(a) an inner layer of concrete having uniformly dispersed metallic fibers, said inner layer completely surrounding and being contiguous with said metallic housing; and (b) an outer layer of concrete having polymers therein to provide a high fluid impermeability, said outer layer completely surrounding and being contiguous with said inner layer.

5. A system for fixed storage of spent nuclear fuel having radioactive species contained within a metallic fuel rod housing, comprising:

(a) an inner layer of concrete having uniformly dispersed metallic fibers and a preselected free moisture content, said inner layer completely surrounding and being in contact with said metallic housing; and (b) an outer layer of concrete having polymers therein and a free moisture content lower than said preselected free moisture content of said inner layer, said outer layer being in contact with and completely surrounding said inner layer.

6. A method for fixedly storing spent nuclear fuel having radioactive species contained within a metallic fuel rod housing, comprising:

(a) completely and contiguously enclosing said housing in an inner layer of concrete having uniformly dispersed metallic fibers and a preselected free moisture content; and (b) completely and contiguously enclosing said inner layer of concrete in an outer layer of concrete having polymers therein and a free moisture content lower than said preselected free moisture content of said inner layer.

7. A system for fixed storage of a spent nuclear fuel assembly having a plurality of fuel rods bundled together by support structure, said rods including radioactive species disposed within a sealed cladding, said system comprising a concrete mixture contiguously and completely surrounding said assembly, intact, having metallic fibers to enhance thermal conductivity and polymers to enhance impermeability.

8. A system for fixed storage of a spent nuclear fuel assembly having a plurality of fuel rods bundled together by support structure, said rods including radioactive species disposed within a sealed cladding, said system comprising (a) an inner concrete mixture completely and contiguously surrounding said assembly, said inner mixture having uniformly dispersed metallic fibers; and (b) an outer concrete mixture completely surrounding said inner mixture, said outer mixture having polymers therein.

* * * * *